US005853235A

United States Patent [19]

Barnes

[11] Patent Number: 5,853,235

[45] Date of Patent: Dec. 29, 1998

[54] BURGLAR-PROOF JEWELRY CASE

[76] Inventor: Harry W. Barnes, 1640 Dyre St., Philadelphia, Pa. 19124

[21] Appl. No.: 862,947

[22] Filed: May 30, 1997

[51] Int. Cl.[6] ..... A47F 3/00

[52] U.S. Cl. ..... 312/117; 312/114; 312/138.1; 109/46

[58] Field of Search ..... 312/114, 117, 312/118, 120, 124, 217, 139, 138.1, 139.2, 204; 109/54, 55, 46; 232/1 D, 4 D, 31, 57, 43.1; 221/194, 295

[56] References Cited

U.S. PATENT DOCUMENTS

| | | | |
|---|---|---|---|
| 917,705 | 4/1909 | Benjamin . | |
| 939,546 | 11/1909 | Plumer | 312/124 |
| 1,787,809 | 1/1931 | Allen et al. . | |
| 2,030,313 | 2/1936 | Murtaugh, Jr. | 109/46 |
| 2,170,362 | 8/1939 | Zoub | 109/46 |
| 3,716,281 | 2/1973 | Rudder, Jr. | 312/114 |
| 4,141,610 | 2/1979 | Ando | 312/114 |
| 4,421,364 | 12/1983 | Takaniemi | 312/117 X |
| 4,804,877 | 2/1989 | Harwood | 312/114 |
| 5,120,116 | 6/1992 | Amstutz et al. | 312/114 |
| 5,165,768 | 11/1992 | Zarrabi et al. | 312/114 |
| 5,667,136 | 9/1997 | Chen | 232/43.1 X |
| 5,671,984 | 9/1997 | Kodera | 312/114 |

*Primary Examiner*—Peter M. Cuomo
*Assistant Examiner*—James O. Hansen
*Attorney, Agent, or Firm*—Norman E. Lehrer

[57] ABSTRACT

In one embodiment, the burglar-proof jewelry case has a showcase with a front panel, a solid rear panel, two opposing end panels, a glass top panel, and at least one shelf therein. Jewelry is displayed on the shelf which is hingedly connected to the rear panel, and is spaced apart and parallel with the top panel. A solenoid is connected to the shelf and the showcase is mounted on a cabinet. The cabinet has a partially covered steel chamber with a curved opening. When the solenoid is energized, the shelf swings downwardly and any jewelry sitting on the shelf falls into the chamber and becomes unreachable by a thief. In another embodiment, the showcase may have multiple shelves where the shelves are connected to one another by cables. A cable stop is connected to one of the cables and holds the shelves in place. The cable stop is held in place by a solenoid. When the solenoid is energized, the cable stop is released and moves upwardly. In response, the shelves fall successively downwardly and any jewelry sitting on the shelves drops into the curved opening of the steel chamber, unreachable by a thief.

11 Claims, 4 Drawing Sheets

BURGLAR-PROOF JEWELRY CASE

BACKGROUND OF THE INVENTION

The present invention is directed toward a burglar-proof jewelry case for safe guarding jewelry that is displayed in a showcase. The invention is useful in preventing the theft of jewelry where the case is smashed and jewelry may be stolen.

Various devices have been designed which seek to deter thieves from smashing a jewelry case and stealing the valuables contained therein. U.S. Pat. No. 5,165,768 to Zarrabi et al shows a display case comprising two opposing sides, two end panels, a top panel, and a bottom panel. The bottom panel is swingably mounted between the side panels. A sensor circuit is provided which is adapted to actuate the bottom panel and causes the bottom panel to swing downwardly if a burglar tries to steal the contents of the case. Once the bottom panel is released, the valuables placed thereon slide downwardly into a lower security vault, below the display case. However, the device described in Zarrabi et al does not deter the thief from reaching into the security vault and stealing the jewelry once it falls into the vault.

U.S. Pat. No. 3,716,281 to Rudder, Jr. discloses a security display case which includes a swingable door located on the rear panel of the case. The swingable door allows a sales person to quickly place jewelry in the case in a secure area positioned under the case. Again, the device of Rudder, Jr. does not deter the thief from reaching into the secure area and retrieving the jewelry therein.

SUMMARY OF THE INVENTION

The present invention is designed to overcome the deficiencies of the prior art discussed above. It is an object of this invention is to provide a burglar-proof jewelry case which prevents thieves from stealing jewelry.

It is another object of the invention to provide a jewelry case with at least one pivoted shelf which automatically allows the shelf to move downwardly when a burglar has tampered with the jewelry case thereby causing the jewelry sitting on the shelf to drop into a secure chamber out of reach by the thief.

It is also an object to provide a jewelry case with multiple shelves attached to one another by cables and an electromotive means which, in response to a signal that a burglar has tampered with the jewelry case, causes the jewelry sitting on the shelves to drop within a chamber out of reach by the thief.

In a preferred embodiment, the jewelry case comprises a showcase and a cabinet with a steel chamber. The chamber has a curved rear wall and a partially covered opening. The case has at least one shelf hingedly connected to a rear panel of the case but held in its horizontal position by an electrically operated latch. When the latch is energized, the shelf swings downwardly, thereby causing jewelry on the shelf to fall within the steel chamber, out of reach by the thief.

In another embodiment, the case may have multiple shelves connected to one another by cables. At least one of the cables has a cable stop which is held in place by a solenoid and keeps the shelves aligned and spaced apart from one another. When the solenoid is energized, the cable stop is released, causing the shelves to drop successively downwardly so that jewelry on the shelves drops into the steel chamber of the cabinet so that a thief cannot reach the jewelry.

Other objects, features, and advantages of the invention will be readily apparent from the following detailed description of preferred embodiments thereof, taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
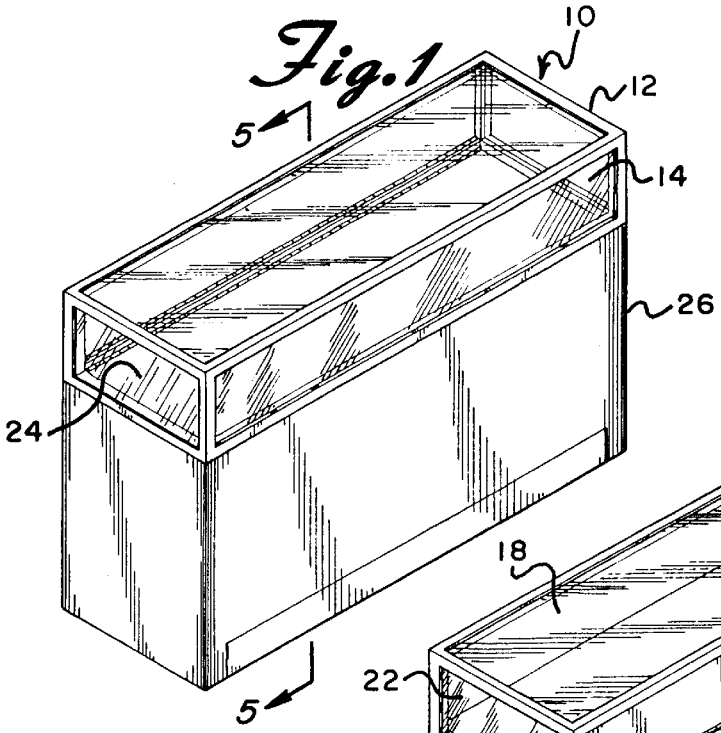
FIG. 1 is a front perspective view of the first embodiment of the jewelry showcase with a single shelf.
Figure 2:
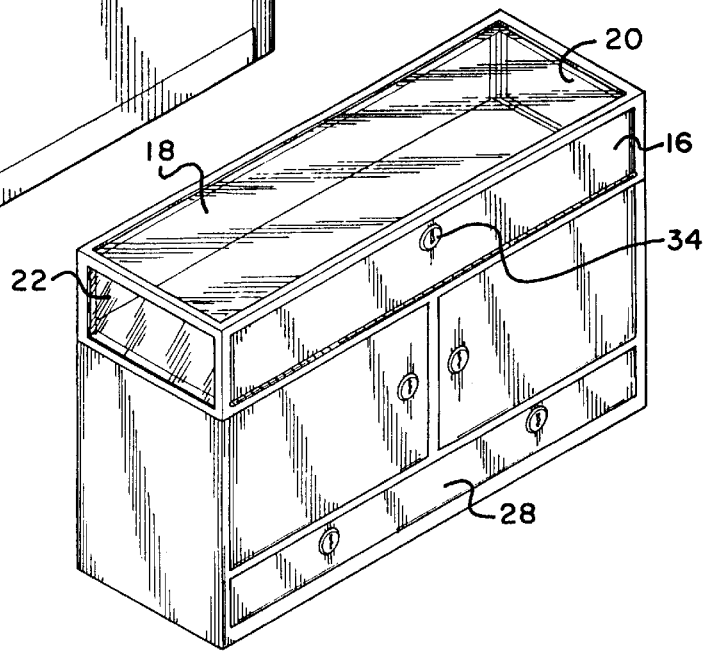
FIG. 2 perspective view of a second embodiment of the jewelry showcase.

Referring now to the drawings in detail wherein like reference numerals have been used throughout the various figures to designate like elements, there is shown in FIGS. 1 and 2 a burglar-proof jewelry case constructed in accordance with the principles of the present invention and designated generally as 10.

In the preferred embodiment the jewelry case essentially includes a showcase 12 with a front panel 14, a solid rear panel 16, a glass top panel 18, end panels 20, 22 and one shelf 24. As shown most clearly in FIG. 5, the shelf 24 is hingedly connected at its back end 25 to the lower portion of the rear panel 16. The shelf 24 is, of course, parallel with the top panel 18 but spaced below the same. Jewelry being displayed generally sits on this shelf. The showcase 12 is preferably mounted upon a cabinet 26 of generally known construction. The cabinet 26, however, includes a solid shelf or floor 27 in the lower portion thereof. This provides space at the bottom of the cabinet 26 for a steel or otherwise rigidly constructed secure chamber 28. The chamber 28 could be in the form of a locked drawer that can be pulled in or out of the cabinet 26 or it could be a fixed structure with a door at the rear thereof. In any case, the chamber 28 will be the most secure portion of the jewelry case accessible only to an employee having the proper keys and authorization.

The floor 27 directly above the steel chamber 28 has an opening 30 therein adjacent the front wall of the cabinet 26. Preferably, the opening 30 extends throughout the entire length of the cabinet. The width of the opening 30, however, from front to back should preferably be only several inches thereby making it difficult for a person to reach his or her hand through the same and into the chamber 28. The forwardmost wall 32 of the chamber 28 is curved as shown most clearly in FIG. 5. In this way, jewelry or any other articles that may pass through the opening 30 would slide away from the opening 30 and into the rearward portion of the chamber 28 so as not to be visible or accessible through the opening 30.

Figure 5:
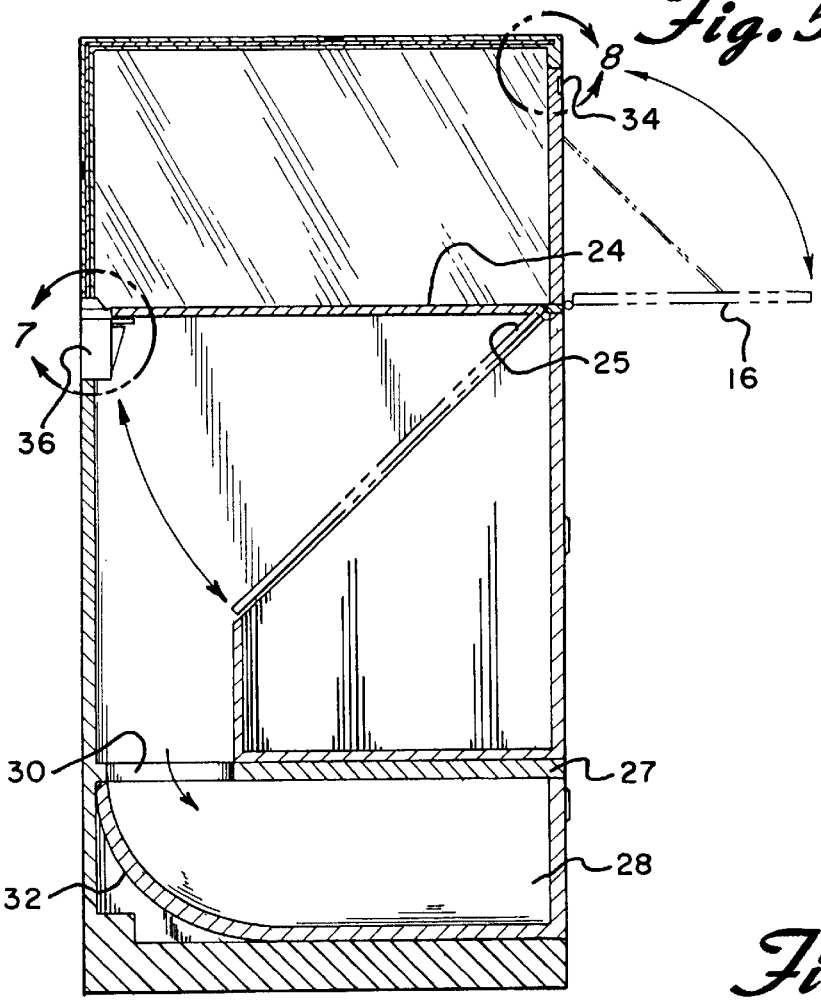
FIG. 5 is a cross-sectional view of the first embodiment taken along line 5—5 of FIG. 1.

As is also shown most clearly in FIG. 5, the shelf 24 is movable between an operative horizontal position wherein it can be used to display jewelry or other valuables and an inoperative lower position shown in phantom where jewelry would slide off of the shelf by the force of gravity. The shelf 24, however, is normally held in its operative or horizontal position through the use of a latch means 36, the details of which are shown most clearly in FIG. 7.

The electrically operated latch means 36 includes an electromagnet 40, a steel backing plate 48 and a shelf support 50. The plate 48 and support 50 are normally biased by spring 46 away from the electromagnet 40 so as to support the shelf 24. When the electromagnet 40 is energized through wires 42 and 44, the plate 48 is pulled toward the electromagnet 40, releasing support 50. This action, in turn, causes shelf 24 to swing downwardly. Any jewelry sitting on the shelf 24 slides through the opening 30 of the floor 27 and into the steel chamber 28. The curved front wall 32 causes the jewelry to slide far into the chamber, making the jewelry unreachable by a thief.

Figure 7:
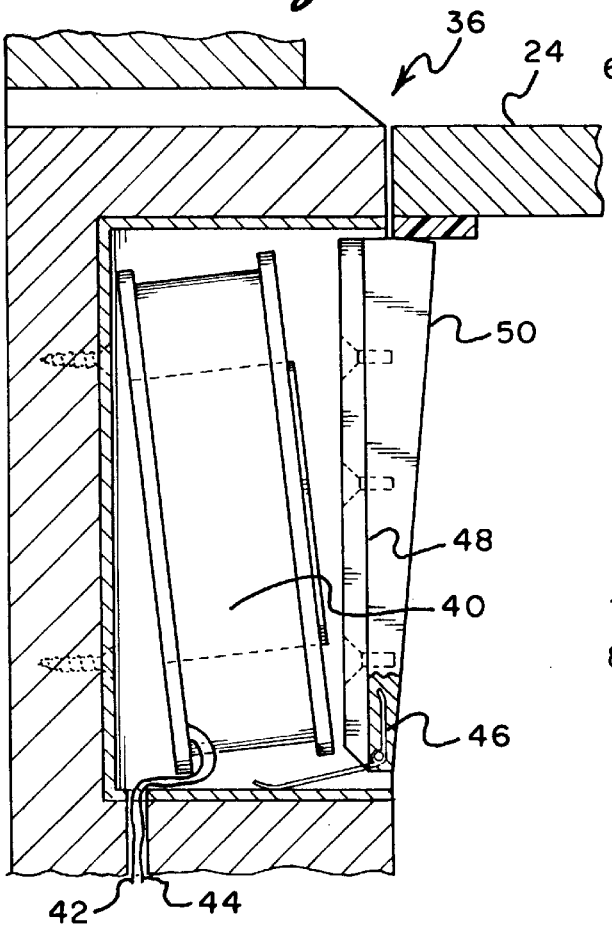
FIG. 7 is a cross-sectional view of an electrically operated latch used in the first embodiment of the present invention and taken along the line 7 of FIG. 5.

When it is desired to reset the shelf 24 after the latch 36 has been operated, all that is necessary is to lift the forward end of the shelf upwardly. As the shelf is moved upwardly, it eventually engages the outer edge of the vertical portion of the shelf support 50 and cams it toward the electromagnet 40 against the force of the biasing spring 46. When the forward end of the shelf 24 rises above the top of the shelf support 50, the support again moves outwardly away from the electromagnet 40 by the force of the spring 46 and again rests beneath the shelf 24 as shown in FIG. 7.

Although in the preferred embodiment of the invention described above, the jewelry case is stated to include a showcase 12 mounted on top of a cabinet 26, this is by way of example only. As should be readily apparent to those skilled in the art, the entire jewelry case could be made of unitary construction with the showcase 12 and cabinet 26 being essentially made in one piece. Even further, while the jewelry case has been shown having a plurality of doors with locks thereon, this is also by way of example only. Obviously, such cabinets or jewelry cases could have any number of doors or drawers that can be arranged in different configurations. Furthermore, the doors could open upwardly or downwardly or be hinged on the left or the right as may be desired or as may be required in any particular installation.

The latch means 36 is, of course, intended to be automatically activated in order to lower the shelf 24. This can be accomplished utilizing something as simple as a button or switch activated by a store attendant should he or she sense trouble or by an intrusion sensor or the like which may indicate when the glass is broken. Such devices are well known in the art. Alternatively, means could be provided for sensing when a lock mechanism of the jewelry case is being tampered with.

Figure 4:
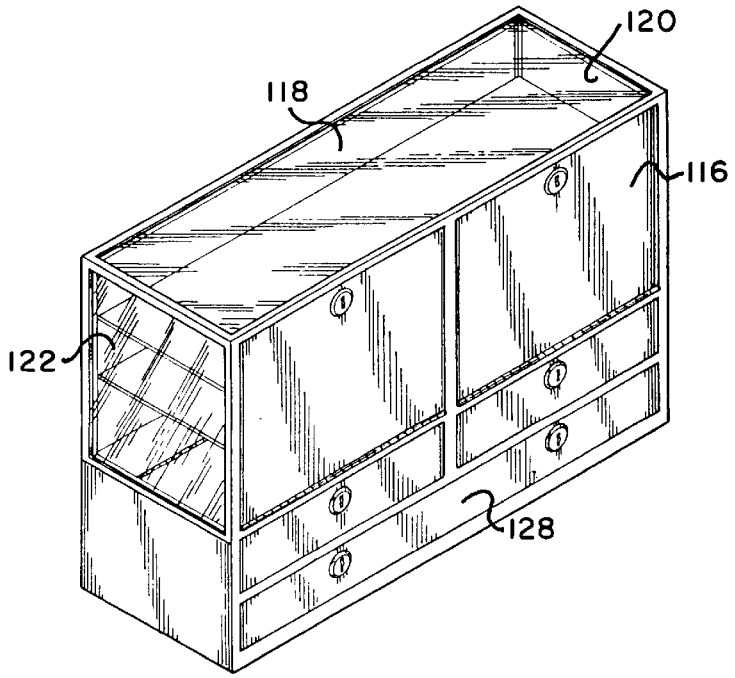
FIG. 4 is a rear perspective view of the second embodiment of the jewelry showcase.
Figure 8:
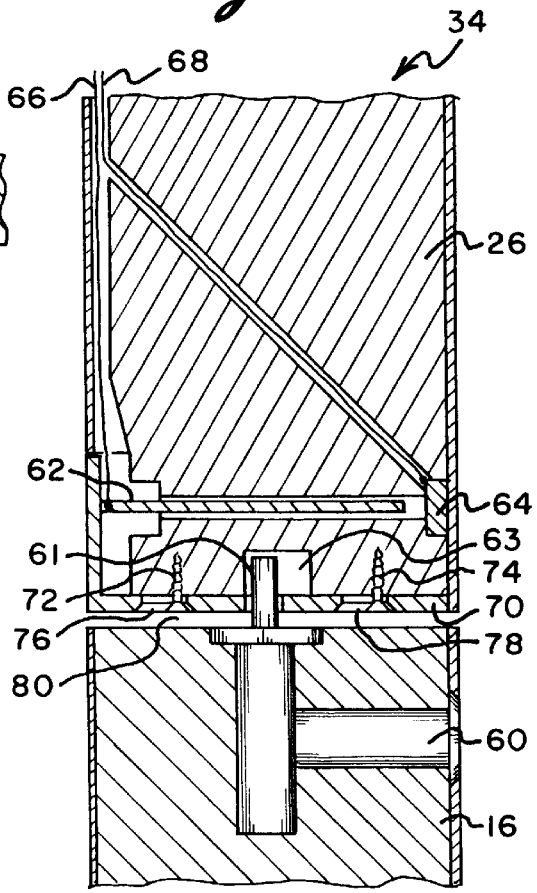
FIG. 8 is a cross-sectional view of the lock means shown in FIGS. 5 and 6 and taken along line 8 of FIG. 5.

FIG. 8 shows a lock means 34 with a sensor which prevents a thief from prying open the lock of the jewelry case. This lock means 34 may be used in either the first or second embodiments of the invention. Multiple locks means are shown in FIGS. 2 and 4. For purposes of illustration, however, the lock means will be described with respect to the first embodiment of the invention.

The lock means 34 includes a lock 60 located in cabinet door 16 and a cylindrical pin 61 which slidably fits into an recess 63 in cabinet 26 locking the jewelry case. Metal plates 62 and 70 are mounted in cabinet 26 as is a contact 64 which is spaced from the plate 62. Wire 66 and 68 are attached to the metal plate 62 and contact 64, respectively. When a thief tries to pry open the lock means by inserting an object into recess 80, pin 61 pushes against plate 70 and the metal plates 62 and 70 shift toward contact means 64. Plate 62 touches contact means 64 and signals an alarm which energizes the electromagnet 40. As a result, the shelf falls as described above and the jewelry falls into the opening of the steel chamber, out of reach by the thief.

Figure 3:
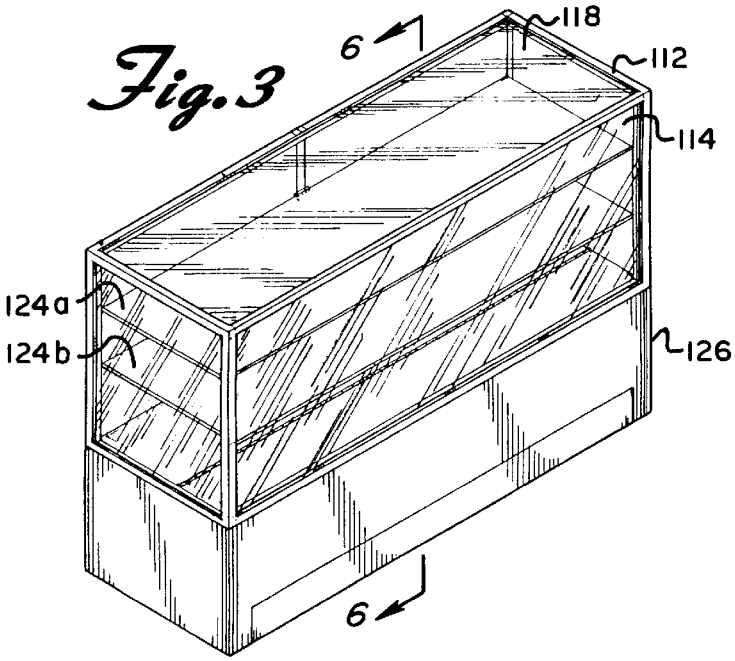
FIG. 3 is a front perspective view of the second embodiment of the jewelry showcase.
Figure 6:
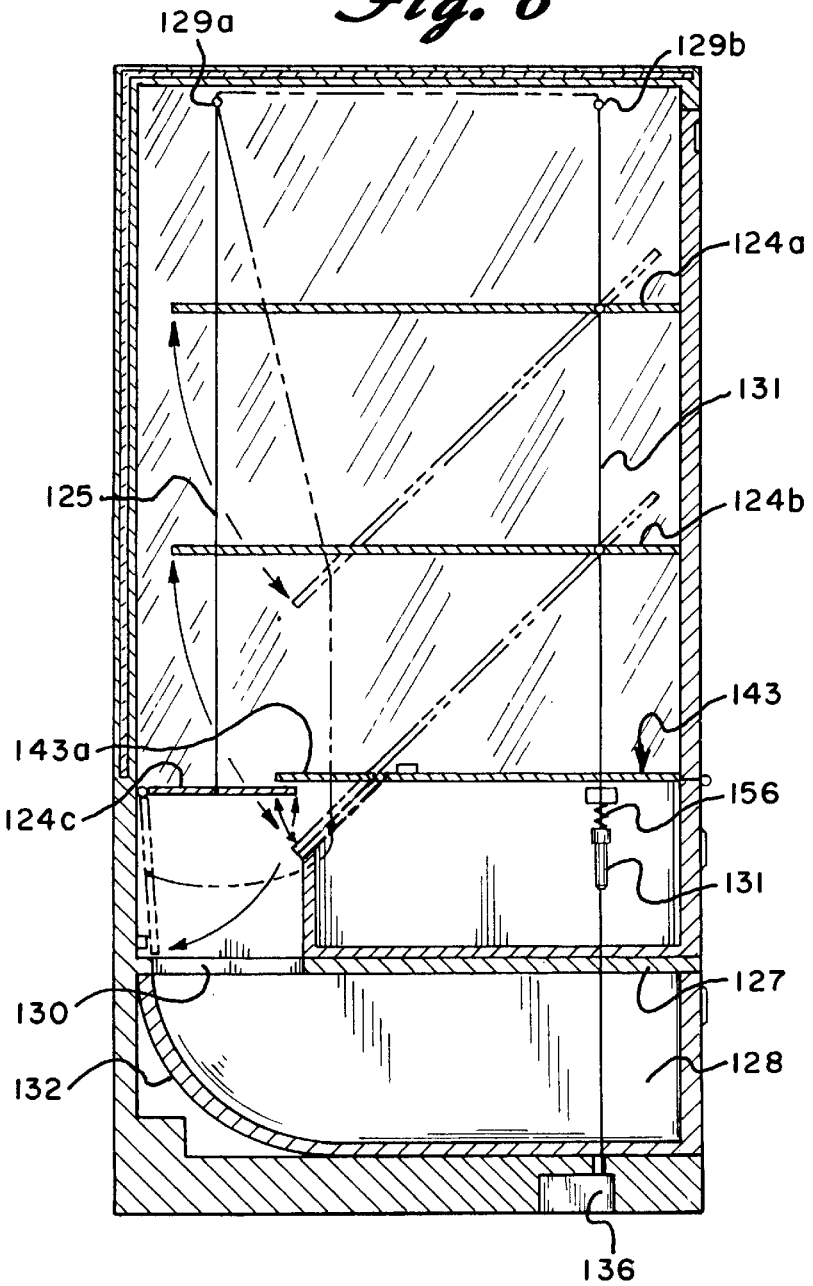
FIG. 6 is a cross-sectional view of the second embodiment taken along line 6—6 of FIG. 3.
Figure 10:
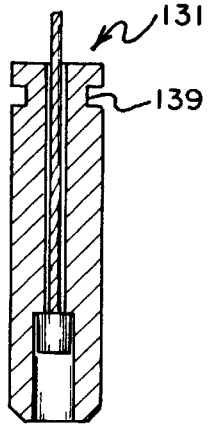
FIG. 10 is an enlarged sectional view of a cable stop used in the second embodiment of the present invention.

In a second embodiment of the invention, as seen in FIGS. 3, 4 and 6, the showcase 112 has a front panel 114, a solid rear panel 116, a glass top panel 118, end panels 120, 122 and first, second and third shelves 124*a*, 124*b* and 124*c* spaced apart respectively located within the showcase 112. As can be see most clearly from FIG. 6, first shelf 124*a* completely overlies second shelf 124*b*. The shelves 124*a*, 124*a* and 124*c* are connected to one another at their ends by cable 125 which then passes up over pulleys 129*a* and 129*b* and down through openings in the shelves. The end of the cables 131 has a cable stop means 131. Again, the case 112 is mounted on a cabinet 126 with a steel chamber 128 and an opening 130 in the floor 127.

Figure 9:
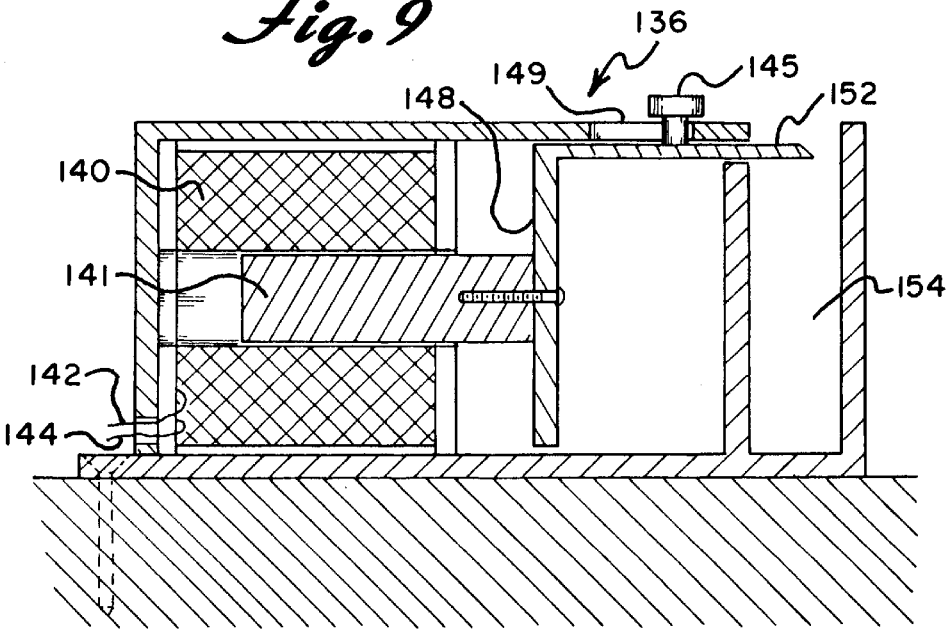
FIG. 9 is a sectional view showing the details of a latch used in the second embodiment of the present invention.

In this embodiment, the jewelry case also includes a latch means 136 (FIG. 9) with a solenoid 140, plunger 141, a plate 148 and bifurcated fingers 152 that hold the cable stop means 131 in a locked position to keep the shelves aligned and spaced apart from one another.

Normally, the cable stop means 131 is received in the housing 154 with the fingers 152 inserted into the groove 139. The fingers 152 can be removed from the groove by either energizing the solenoid 140 or manually by pushing back on the button 145 which extends upwardly within the slotted opening 149.

When the solenoid 140 is energized, the cable stop means 131 is released and moves upwardly until it hits the shock absorbing spring 156. This, in turn, causes the shelves 124*a*, 124*b* and 124*c*, to fall successively, downwardly. At the same time, the forward end 143*a* of lower shelf 143 also moves downwardly. When the shelves fall, the jewelry sitting on the shelves 124*a*, 124*b*, 124*c* and 143*a* fall through the opening 130. Chamber 128 has a curved front wall 132 which causes the jewelry to slide far into the chamber, making the jewelry unreachable by a thief.

The present invention may be embodied in other specific forms without departing from the spirit or essential attributes thereof and accordingly, reference should be made to the appended claims rather than to the foregoing specification as indicating the scope of the invention.

I claim:

1. A burglar-proof jewelry case comprising:

a showcase having first and second spaced apart shelves therein, on which shelves jewelry may be placed for display, said shelves being arranged vertically with respect to each other, said first shelf completely overlying said second shelf;

said shelves being mounted for pivotal movement between an operative substantially horizontal position and an inoperative position wherein said shelves extend at least partially downwardly so that jewelry can slide off of said shelves;

electrically operated latch means for maintaining said shelves in said operative position, said latch means being capable of being electrically operated so as to release said shelves thereby allowing said shelves to move into said inoperative position;

said showcase further including a bottom wall having an opening formed through a portion thereof;

a secure chamber located within said showcase beneath said bottom wall, said secure chamber communicating with said opening in said bottom wall and having a curved wall beneath said opening whereby when said latch means is activated, said shelves fall by gravity from said operative position to said inoperative position allowing jewelry thereon to fall off of said shelves, through said opening wherein the jewelry is guided by said curved wall into an inaccessible portion of said secure chamber.

2. The burglar-proof jewelry case as claimed in claim 1 wherein said plurality of shelves are interconnected so as to move together.

3. The burglar-proof jewelry case as claimed in claim 2 wherein said shelves are interconnected through the use of a cable means and wherein said latch means is adapted to hold or release an end of said cable means.

4. The burglar-proof jewelry case as claimed in claim 1 further including a means for sensing when said showcase is being tampered with and means for activating said electrically operated latch means in response to said sensing means.

5. The burglar-proof jewelry case as claimed in claim 4 wherein said showcase further includes at least one door including a lock thereon and wherein said sensing means includes a means for indicating when an attempt is made to open said door without unlocking said door.

6. A burglar-proof jewelry case comprising:

a showcase having a glass top panel, a glass front panel, end panels, and a shelf therein on which jewelry may be placed for display;

said shelf being mounted for pivotal movement between an operative substantially horizontal position and an inoperative position wherein said shelf extends at least partially downwardly so that jewelry can slide off of said shelf;

electrically operated latch means for maintaining said shelf in said operative position, said latch means being capable of being electrically operated so as to release said shelf thereby allowing said shelf to move into its inoperative position;

said showcase further including a bottom wall having an opening formed through a portion thereof;

a secure chamber located within said showcase beneath said bottom wall, said secure chamber communicating with said opening in said bottom wall and having a curved wall beneath said opening whereby when said latch means is activated, said shelf falls by gravity from its operative position to its inoperative position allowing jewelry thereon to fall off of said shelf, through said opening wherein the jewelry is guided by said curved wall into an inaccessible portion of said secure chamber.

7. The burglar-proof jewelry case as claimed in claim 6 further including a plurality of shelves, each of said shelves being movable between an operative position and an inoperative position and being held in said operative position by said latch means.

8. The burglar-proof jewelry case as claimed in claim 7 wherein said plurality of shelves are interconnected so as to move together.

9. The burglar-proof jewelry case as claimed in claim 8 wherein said shelves are interconnected through the use of a cable means and wherein said latch means is adapted to hold or release an end of said cable means.

10. The burglar-proof jewelry case as claimed in claim 6 further including a means for sensing when said showcase is being tampered with and means for activating said electrically operated latch means in response to said sensing means.

11. The burglar-proof jewelry case as claimed in claim 10 wherein said showcase further includes at least one door including a lock thereon and wherein said sensing means includes a means for indicating when an attempt is made to open said door without unlocking said door.

* * * * *